US006041848A

United States Patent [19]

Langner

[11] Patent Number: 6,041,848

[45] Date of Patent: Mar. 28, 2000

[54] ADJUSTABLE CONTINUOUS CASTING MOLD

[75] Inventor: Carl Langner, Monsey, N.Y.

[73] Assignee: SMS Concast Division of SMS-Schloemann Siemag Inc., Pittsburgh, Pa.

[21] Appl. No.: 09/006,684

[22] Filed: Jan. 13, 1998

[51] Int. Cl.[7] ..... B22D 11/04; B22D 11/16

[52] U.S. Cl. ..... 164/491; 164/436

[58] Field of Search ..... 164/459, 418, 164/491, 436, 479

[56] References Cited

U.S. PATENT DOCUMENTS

| | | | |
|---|---|---|---|
| 4,480,976 | 11/1984 | Vaubel et al. | 164/491 X |
| 4,537,240 | 8/1985 | Tsuchida et al. | 164/479 X |
| 4,770,228 | 9/1988 | Artz et al. | 164/436 X |

FOREIGN PATENT DOCUMENTS

| | | | |
|---|---|---|---|
| 0241825 | 10/1987 | European Pat. Off. . | |
| 0268143 | 5/1988 | European Pat. Off. | 164/491 |
| 61-176446 | 8/1986 | Japan | 164/436 |
| 62-240145 | 10/1987 | Japan | 164/436 |

*Primary Examiner*—J. Reed Batten, Jr.
*Attorney, Agent, or Firm*—Antonio R. Durando

[57] ABSTRACT

A continuous casting mold assembly has four mold walls in the form of discrete plates. The mold walls are arranged with an edge face of each wall abutting a major face of an adjacent mold wall. To permit changes in taper, each of the mold walls is mounted for pivotal movement on two orthogonal axes. The mold walls are held together by springs which can be hydraulically relieved when the mold walls are to be adjusted. The mold walls tend to move away from one another following hydraulic relief of the springs, and such movements are limited by screws associated with the respective mold walls. The screws contact abutments when the mold walls have moved apart by distances large enough to allow pivoting of the walls but not large enough to permit molten material to leak between the walls.

24 Claims, 2 Drawing Sheets

ADJUSTABLE CONTINUOUS CASTING MOLD

BACKGROUND OF THE INVENTION

1. Field of the Invention

The invention relates to a continuous casting mold.

2. Description of the Prior Art

Continuous casting molds are generally tapered to take account of the shrinkage undergone by a continuously cast strand as it cools. Ideally, the taper allows the strand to remain in contact with the mold as the strand moves therethrough while maintaining the friction between the strand and the mold at low levels. Contact between the strand and the mold is desirable because heat transfer from the strand to the mold occurs much more efficiently than when an air gap is present between the strand and the mold.

The taper depends not only on the material being cast but also on the casting conditions which usually change during the course of a casting operation. Thus, for best results, the taper should vary with the casting conditions. This is not possible with the tube molds used for the casting of smaller sections but can be accomplished with the plate molds employed for larger sections. The plate molds currently in use are normally rectangular and have two wide plates and two narrow plates which make up the walls of the mold. The narrow walls are clamped between the wide walls, and systems have been developed for changing the inclinations of the narrow walls during a casting operation. As the inclinations of the narrow walls are changed, a change of taper occurs widthwise of the mold. However, the inclinations of the wide walls cannot be changed because gaps would form between the wide walls and the narrow walls.

The European Patent Application No. 0 241 825 discloses a plate mold in which all of the walls can be moved without creating gaps. In this mold, an edge face of each mold wall abuts a major face of a neighboring mold wall. The mold is intended to permit changes in cross section and taper during a casting operation. To this end, at least one of the mold walls is shiftable at an acute angle to its major faces by one or more threaded spindles. Furthermore, in one embodiment of the mold, one of the mold walls is pivotable on an axis perpendicular to its major faces while another of the mold walls is pivotable on an axis parallel to its major faces. In an additional embodiment of the mold, each of the mold walls is pivotable on an axis parallel to the major faces thereof. One of the mold walls is also slidable in a guide which allows such mold wall to follow the change in inclination of a neighboring mold wall. As an alternative to the slidable mounting of a mold wall, the European Patent Application teaches that elastic buffers can be provided between the mold walls and their drive spindles in order to absorb small pivoting motions.

The mold of the European Patent Application is somewhat cumbersome and does not allow the taper to be changed as easily and effectively as desirable.

SUMMARY OF THE INVENTION

It is an object of the invention to improve the operation of changing taper.

The preceding object, as well as others which will become apparent as the description proceeds, are achieved by the invention.

One aspect of the invention resides in a continuous casting mold assembly. The assembly comprises a selected mold wall, and means for mounting the mold wall for pivotal movement on a first axis and on a second axis transverse to the first axis.

If the selected mold wall forms part of a mold in which an edge face of each mold wall abuts a major face of a neighboring mold wall, one of the pivot axes may be perpendicular to the major faces of the selected mold wall while the other may be perpendicular to the edge faces thereof. To change the inclination of the selected mold wall, the latter is then pivoted on the axis which is perpendicular to its edge faces. On the other hand, when a neighboring mold wall which abuts an edge face of the selected mold wall is pivoted to change the inclination of the neighboring mold wall, the selected mold wall pivots on the axis which is perpendicular to its major faces. This permits the inclination of the neighboring mold wall to be changed in a simple manner while allowing the selected mold wall to readily adjust to the changing inclination of the neighboring mold wall.

Another aspect of the invention resides in a method of operating a casting mold having a selected mold wall. The method comprises the steps of pivoting the selected mold wall on a first axis, and pivoting the selected mold wall on a second axis transverse to the first axis. The pivoting steps are preferably performed on substantially perpendicular axes.

The method can further comprise the step of pivoting another mold wall on a third axis in response to pivoting of the selected mold wall.

The selected mold wall may have a major face and a minor face, and the step of pivoting this mold wall on the first axis can then be performed using an axis substantially parallel to one of the faces. On the other hand, the step of pivoting the selected mold wall on the second axis can be carried out using an axis substantially parallel to the other of the faces.

The method may comprise the additional steps of clamping the selected mold wall with a predetermined force, reducing the clamping force, and limiting movement of the selected mold wall in a predetermined direction upon reduction of the clamping force.

The clamping step can involve urging the selected mold wall against an additional wall of the mold. When the clamping force is reduced, the selected mold wall may then move in a direction away from the additional mold wall. Under such circumstances, movement of the selected mold wall is advantageously limited to a distance such that the selected mold wall can pivot relative to the additional mold wall while leakage of molten material between the selected mold wall and the additional mold wall is substantially prevented.

Other features and advantages of the invention will be forthcoming from the following detailed description of preferred embodiments when read in conjunction with the accompanying drawings.

DESCRIPTION OF THE PREFERRED EMBODIMENTS

Figure 1:
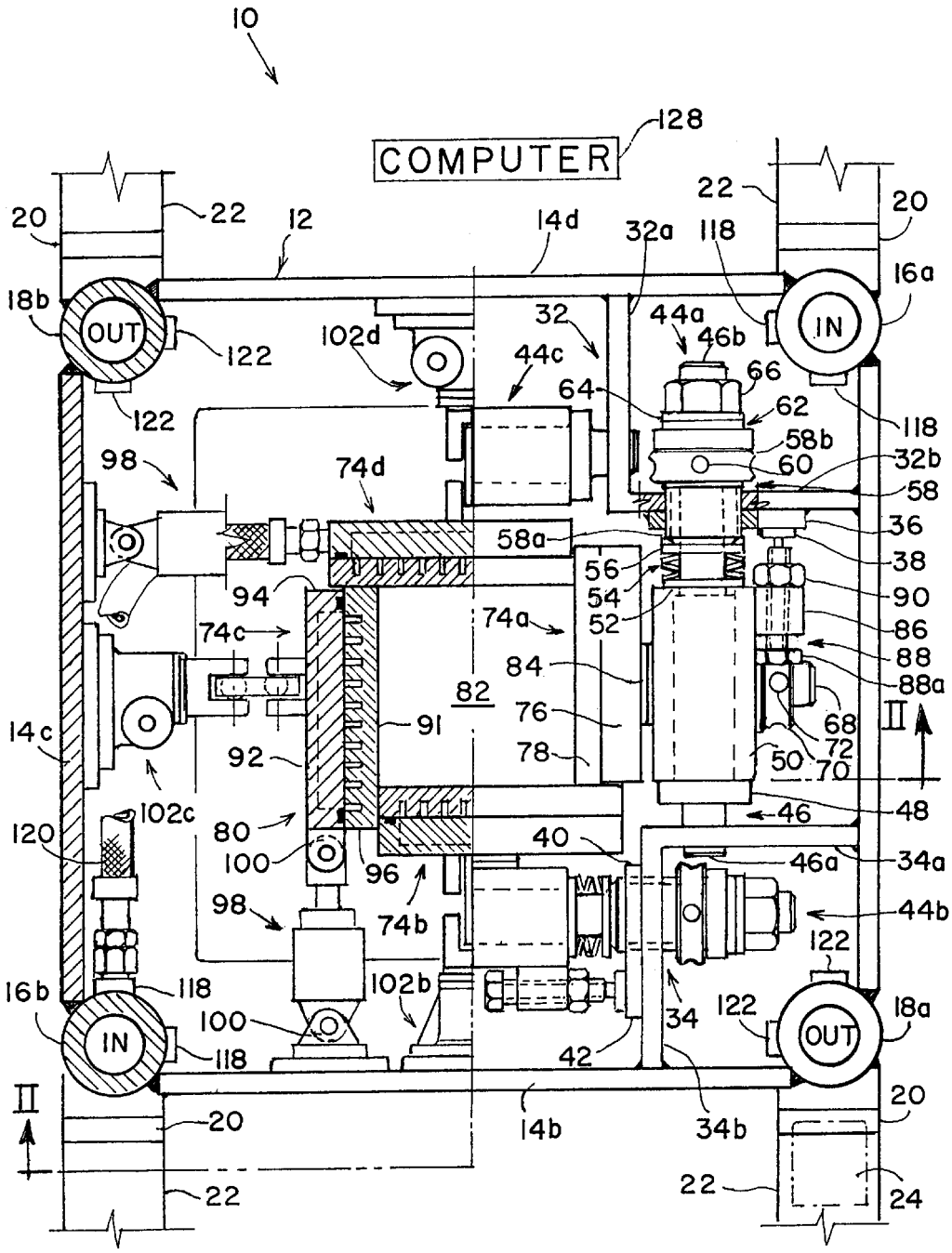
FIG. 1 is a partly sectional plan view of a mold assembly in accordance with the invention.
Figure 2:
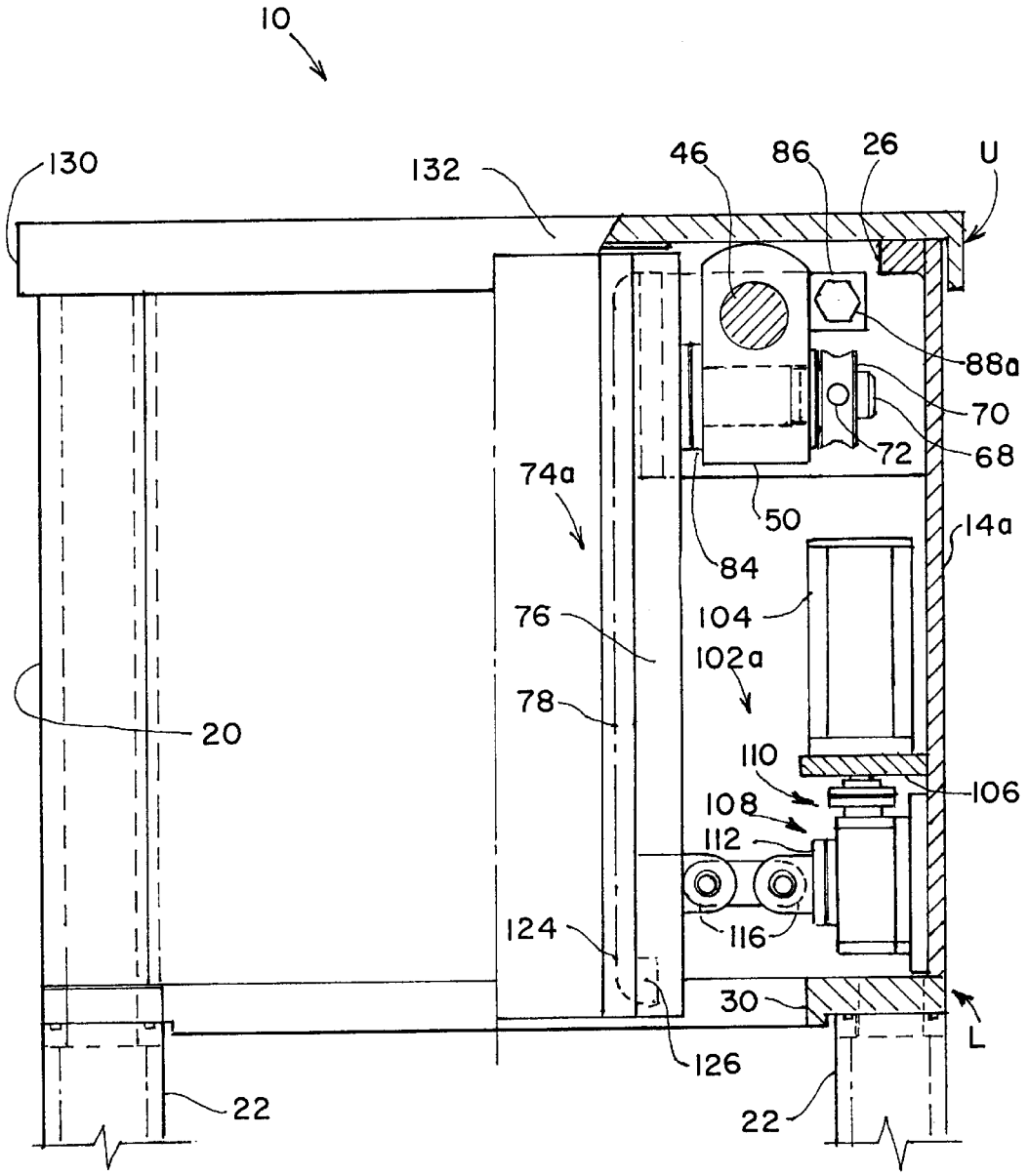
FIG. 2 is a view in the direction of the arrows II—II of FIG. 1.

Referring to FIGS. 1 and 2, the numeral 10 identifies a mold assembly according to the invention. The mold assembly 10 is designed for use in a continuous casting apparatus, particularly an apparatus for the continuous casting of steel.

The mold assembly 10 includes a generally square or rectangular frame or support 12 having an upper end U and a lower end L. The frame 12 is made up of four frame plates 14*a*, 14*b*, 14*c* and 14*d* which are welded to pipes 16*a*, 16*b*, 18*a* and 18*b* located at the corners of the frame 12. The pipes 16*a*,16*b* serve as inlets for cooling fluid while the pipes 18*a*, 18*b* serve as outlets for the cooling fluid.

Mounting legs or bars 20 are secured to the outside of the frame 12 at the corners and function to mount the mold assembly 10 on a mold table 22 of a continuous casting apparatus. The mold table 22 is supported on an oscillator 24 which reciprocates the mold table 22 during a continuous casting operation.

A reinforcing flange 26 best seen in FIG. 2 runs around the upper end U of the frame 12. A second reinforcing flange 30 extends around the frame 12 at the lower end L thereof while a third reinforcing flange 106 runs around the frame 12 at a level between the flanges 26,30.

A carrying or mounting unit is located in each corner of the frame 12. The carrying units are identical, and each carrying unit consists of two carrying or mounting plates which are welded to one another and to respective ones of the frame plates 14*a*–14*d* at right angles. Two of the carrying units are visible in FIG. 1 and are denoted by 32 and 34, respectively. The carrying plates of the carrying unit 32 are identified by 32*a* and 32*b* while the carrying plates of the carrying unit 34 are identified by 34*a* and 34*b*. An abutment plate 36 is disposed on the outer surface of the carrying plate 32*b* and supports an abutment 38. Similarly, an abutment plate 40 is situated on the outer surface of the carrying plate 34*b* and supports an abutment 42.

The carrying units support four clamping and pivoting mechanisms. One clamping and pivoting mechanism is visible in its entirety in FIG. 1 and is identified by 44*a* while two clamping and pivoting mechanisms are shown in part and are denoted by 44*b* and 44*c*, respectively. The clamping and pivoting mechanisms are elongated and extend horizontally in parallelism with the respective frame plates 14*a*–14*d*. The clamping and pivoting mechanisms are advantageously located nearer the top than the bottom of the mold assembly 10. Preferably, the clamping and pivoting mechanisms are disposed at or near the meniscus level, that is, at or near the level of the upper surface of the liquid which is present in the mold assembly 10 during a continuous casting operation.

The four clamping and pivoting mechanisms are identical and will be described with reference to the clamping and pivoting mechanism 44*a*.

The clamping and pivoting mechanism 44*a* includes a shaft or spindle 46 which is shiftable longitudinally. The shaft 46 has an end 46*a* which extends through an opening in and is supported by the carrying plate 34*a* of the carrying unit 34. The shaft 46 also extends through the carrying plate 32*b* of the carrying unit 32 and has a threaded end 46*b* to that side of the carrying plate 32*b* remote from the carrying unit 34.

A collar or shoulder 48 is formed on the shaft 46 adjacent the end 46*a* and is spaced from the carrying plate 34*a*. The shaft 46 has a section of larger diameter than the end 46*a*, and such section extends from the collar 48 partway to the threaded end 46*b*. On the side of the larger-diameter section remote from the end 46*a*, the diameter of the shaft 46 is again the same as that of the end 46*a*.

An elongated main block 50 is mounted on the larger-diameter section of the shaft 46 for pivotal movement on the axis of the latter. The main block 50 is located on that side of the collar 48 remote from the end 46*a* of the shaft 46. The main block 50 has opposite longitudinal end faces, and one of the end faces bears against the collar 48. A steel washer 52 abuts the other end face and serves as a seat for one end of a compression spring 54. A second steel washer 56 sits against the other end of the compression spring 54.

The compression spring 54 is prestressed in compression by a hollow nut 58 which bears against the washer 56. The hollow nut 58 has an externally threaded portion 58*a* of smaller diameter and another portion 58*b* of larger diameter. The smaller-diameter portion 58*a* is received in a threaded opening formed in the carrying plate 32*b* of the carrying unit 32. By rotating the hollow nut 58, the compression spring 54 can be placed under a compressive stress of desired magnitude. The larger-diameter portion 58*b* is provided with tightening holes 60 for clamping the hollow nut 58 to the shaft 46. Only one of the tightening holes 60 is visible in the drawings.

A hydraulic nut 62 is sandwiched between the hollow nut 58 and a steel washer 64 located at the threaded end 46*b* of the shaft 46. A nut 66 screwed onto the threaded end 46*b* holds the hydraulic nut 62 and washer 64 on the shaft 46.

A shaft 68 passes through the main block 50 below and at right angles to the shaft 46. A nut 70 sits on one end of the shaft 68 and has tightening holes 72 for clamping the nut 70 to the shaft 68. The other end of the shaft 68 carries a mold wall 74*a* made up of a backup plate 76 and a copper liner or facing 78. The mold wall 74*a* constitutes one side of a continuous casting mold 80 having three additional mold walls 74*b*, 74*c* and 74*d* which cooperate with the mold wall 74*a* to define a mold cavity or passage 82 of square or rectangular cross section. The mold walls 74*a*–74*d* are here straight but could also be curved.

The shaft 68 is rotatable in the main block 50. Accordingly, the mold wall 74*a* can pivot on the axis of the shaft 68 as well as on the axis of the shaft 46.

The shaft 68 is also shiftable longitudinally on the main block 50. This enables the mold wall 74*a* to be moved in axial direction of the shaft 68 to thereby change the internal dimensions of the mold cavity 82. The internal dimensions of the mold cavity 82 can be fixed by placing shims 84 on the shaft 68 between the mold wall 74*a* and the main block 50.

An auxiliary block 86 is fixed to that side of the main block 50 remote from the mold wall 74*a*. The auxiliary block 86 has a threaded passage which is parallel to the shaft 46, and a screw 88 extends through the passage. The screw 88 has a head 88*a* to one side of the auxiliary block 86, and a nut 90 is threaded onto the screw 88 on the opposite side of the auxiliary block 86. The end of the screw 88 confronts the abutment 38 on the carrying plate 32*b*. During a continuous casting operation, the end of the screw 88 is spaced from the abutment 38 by a small gap. The width of the gap, which will normally be several thousandths of an inch, can be adjusted by rotating the screw 88. The screw 88 limits displacement of the main block 50, and hence of the mold wall 74*a*, towards the frame plate 14*d* in axial direction of the shaft 46.

Each of the mold walls 74*a*–74*d* has a major face or surface 91 which confronts the mold cavity 82 and an opposite major face or surface 92 which confronts and is engaged by the respective clamping and pivoting mechanism. Each of the mold walls 74*a*–74*d* further has an edge face or surface 94 as well as an opposite edge face or surface 96. The mold walls 74*a*–74*d* are arranged with the edge face 94 of each mold wall 74*a*–74*d* abutting the major face 91 of a neighboring mold wall 74*a*–74*d*.

Each of the mold walls 74*a*–74*d* is pivotable on an axis parallel to its major faces 91,92 and on an axis perpendicular to its major faces 91,92. For instance, the mold wall 74*a* is pivotable on the axis of the shaft 46 which extends parallel to the major faces 91,92 of the mold wall 74*a* and on the axis of the shaft 68 which extends perpendicular to the major faces 91,92 of the mold wall 74*a*. This pivotal mounting of the mold walls 74*a*–74*d*, in conjunction with the arrangement of the mold walls 74*a*–74*d* such that the edge faces 94 abut the major faces 91, allows the taper of the mold 80 to be varied by changing the inclination of all the mold walls 74*a*–74*d*. Furthermore, the taper of the mold 80 can be varied without creating unacceptably large gaps between neighboring mold walls 74*a*–74*d*, that is, without creating gaps which would permit the escape of molten material from the mold cavity 82. By way of example, if the mold wall 74*a* is pivoted on the pivot axis parallel to its major faces 91,92 to change the taper of the mold 80, the mold wall 74*d* pivots in the same sense on the pivot axis perpendicular to its major faces 91,92.

In addition to supporting the mold walls 74*a*–74*d* for pivotal movement, the clamping and pivoting mechanisms function to hold the mold walls 74*a*–74*d* together. Considering the clamping and pivoting mechanism 44*a*, the compression spring 54 urges the main block 50 axially of the shaft 46 in a direction towards the frame plate 14*b*. Since the shaft 68 which supports the mold wall 74*a* is mounted on the main block 50, the shaft 68 and mold wall 74*a* are urged towards the frame plate 14*b*. Consequently, the edge face 94 of the mold wall 74*a* is urged against the major face 91 of the mold wall 74*b*.

When the taper of the mold 80 is to be changed, the clamping force exerted by the clamping and pivoting mechanism 44*a* must be reduced to allow pivoting of the mold wall 74*a*. To this end, pressurized hydraulic fluid is admitted into the hydraulic nut 62. The hydraulic nut 62, in turn, urges the nut 66 axially of the shaft 46 in a direction towards the frame plate 14*d*. Since the nut 66 is screwed onto the shaft 46, the shaft 46 is likewise urged towards the frame plate 14*d*. As the shaft 46 is shifted towards the frame plate 14*d*, the collar 48 of the shaft 46 entrains the main block 50 and displaces the latter towards the frame plate 14*d*. Due to the fact that the mold wall 74*a* is coupled to the main block 50 by way of the shaft 68, the mold wall 74*a* moves away from the mold wall 74*b* in response to shifting of the main block 50 towards the frame plate 14*d*. Accordingly, the force between the mold walls 74*a*,74*b* is reduced.

Displacement of the mold wall 74*a* towards the frame plate 14*d* is restricted by the screw 88. Once the screw 88 contacts the abutment 38 on the carrying plate 32*b*, no further movement of the main block 50 and mold wall 74*a* towards the frame plate 14*d* can occur.

The primary purpose of the screw 88 is to permit the taper of the mold 80 to be changed during a continuous casting operation when the mold 80 contains molten material. The gap which normally exists between the screw 88 and the abutment 38 is thus selected on the basis of two criteria. On the one hand, separation of the mold walls 74*a*,74*d* to a degree which would allow molten material to leak from the mold cavity 82 is to be prevented. On the other hand, the frictional force between the mold walls 74*a*,74*b* is to be reduced sufficiently to permit pivoting of the mold wall 74*a* relative to the mold wall 74*b*.

A clamping device 98 is mounted on each of the frame plates 14*a*–14*d*, and each of the clamping devices 98 is connected to the end face 96 of one of the mold walls 74*a*–74*d*. One of the clamping devices 98 is visible in FIG. 1 in its entirety while another of the clamping devices 98 is shown in part. The clamping devices 98 are located nearer the lower end L than the upper end U of the frame 12 and are preferably disposed at the lower end L. The clamping devices 98 are coupled to the frame plates 14*a*–14*d* and to the mold walls 74*a*–74*d* by way of ball bushings 100. The ball bushings 100 are designed to accommodate the pivotal movements of the mold walls 74*a*–74*d* on the pivot axes extending normal to the major faces 91,92 of the mold walls 74*a*–74*d*.

The clamping devices 98 are of the type containing a hydraulic cylinder with a spring pack. Similarly to the compression springs of the clamping and pivoting mechanisms such as the mechanism 44*a*, the spring packs urge the end face 94 of each mold wall 74*a*–74*d* against the major face 91 of a neighboring mold wall 74*a*–74*d*.

When the taper of the mold 80 is to be changed, the force exerted by the clamping devices 98 is reduced simultaneously with the force exerted by the clamping and pivoting mechanisms. The reduction in the force exerted by the clamping devices 98 is achieved hydraulically by means of the hydraulic cylinders incorporated in the clamping devices 98.

Four drive assemblies 102*a*, 102*b*, 102*c* and 102*d* function to pivot the respective mold walls 74*a*–74*d* on the pivot axes extending parallel to the major faces 91,92 of the mold walls 74*a*–74*d*. Each of the drive assemblies 102*a*–102*d* is mounted on a respective frame plate 14*a*–14*d*. The drive assemblies 102*a*–102*d* are identical and will be described with reference to the drive assembly 102*a* for the mold wall 74*a*.

The drive assembly 102*a* includes a motor 104 which sits on the reinforcing flange 106. The reinforcing flange 106 is formed with an opening, and the motor 104 has a motor shaft which extends through the opening. A screw jack 108 is situated below the reinforcing flange 106 and is attached to the frame plate 14*a*. The motor shaft is connected to the screw jack 108 by way of a coupling 110.

The screw jack 108 has a horizontal screw 112 which can be extended and retracted by the motor 104. The screw 112 is connected to the mold wall 74*a* by a linkage which includes two ball bushings 116 to accommodate the pivotal movements of the mold wall 74*a*. With reference to FIG. 2, the mold wall 74*a* pivots clockwise on the shaft 46 as the screw 112 is extended and the taper of the mold 80 increases. The reverse occurs as the screw 112 is retracted.

The backup plates of the mold walls 74*a*–74*d* have cooling channels for circulation of a cooling fluid. Each of the inlet pipes 16*a*,16*b* is provided with two bosses 118, and the bosses 118 are connected to inlets of the cooling channels by way of hose connections. One such hose connection is shown at 120 in FIG. 1 while the remaining connections are indicated by dash-and-dot lines. The bosses 118 of the inlet pipe 16*a* are respectively connected to the cooling channels in the mold walls 74*a* and 74*b* while the bosses 118 of the inlet pipe 16*b* are respectively connected to the cooling channels in the mold walls 74*c* and 74*d*.

Similarly to the inlet pipes 16*a*,16*b*, each of the outlet pipes 18*a*,18*b* is provided with two bosses 122. The bosses 122 are connected to outlets of the cooling channels in the mold walls 74*a*–74*d* by hose connections indicated by dash-and-dot lines. The bosses 122 of the outlet pipe 18*a* are respectively connected to the cooling channels in the mold walls 74*b* and 74*c* whereas the bosses 122 of the outlet pipe 18*b* are respectively connected to the cooling channels in the mold walls 74*a* and 74*d*.

The cooling channel inlets are preferably located at the lower ends and the cooling channel outlets at the upper ends of the mold walls 74*a*–74*d*.

Sensors can be installed in the mold walls 74*a*–74*d* to obtain data on the instantaneous casting conditions. For example, each of the mold walls 74*a*–74*d* could be provided with a sensor for measuring the temperature at the center of the copper liner, a sensor for measuring the temperature of the copper liner near a corner of the mold cavity 82, and a sensor for measuring the temperature of the cooling fluid leaving the backup plate. Two sensors are shown in FIG. 2 and are identified by the numerals 124 and 126.

Data from the sensors is fed to a computer 128 which controls the clamping and pivoting mechanisms, the clamping devices 98 and the drive assemblies 102*a*–102*d*. The computer 128 analyzes the data and determines whether the taper of the mold 80 needs to be changed. If so, the computer 128 causes the clamping and pivoting mechanisms, as well as the clamping devices 98, to loosen their grip on the mold walls 74*a*–74*d*. The computer 128 thereupon effects pivoting of the mold walls 74*a*–74*d*. After the proper taper has been achieved, the computer 128 causes the mold walls 74*a*–74*d* to be tightly gripped once again.

As illustrated in FIG. 2, the mold assembly 10 can be provided with a cover 130. The cover 130 has a central opening 132 which is in register with the mold cavity 82 so as to allow teeming of molten material into the cavity 82. A gap is provided between the cover 130 and the mold walls 74*a*–74*d* in order to prevent the cover 130 from interfering with the pivotal movements of the walls 74*a*–74*d*.

The operation of the mold assembly 10, which is apparent from the preceding description, is summarized briefly below:

Cooling fluid is circulated through the mold walls 74*a*–74*d*. A continuous casting operation is then initiated by directing a stream of molten material, e.g, molten steel, into the mold cavity 82 through the upper end thereof to form a strand or ingot. The strand is continuously withdrawn from the mold cavity 82 through the lower end of the cavity 82.

The mold 80 has an initial taper based on the anticipated casting conditions. The computer 128 receives data from the sensors in the mold walls 74*a*–74*d* and evaluates the data to ascertain whether the actual casting conditions deviate sufficiently from the anticipated casting conditions to require a change in taper. If this is the case, the computer 128 calculates a new taper and generates a signal which causes pressurized hydraulic fluid to flow to the hydraulic cylinders of the clamping devices 98 and to the hydraulic nuts of the clamping and pivoting mechanisms. The hydraulic fluid overcomes the action of the spring packs in the clamping devices 98 and the action of the compression springs in the clamping and pivoting mechanisms and causes the mold walls 74*a*–74*d* to move away from another. Accordingly, the clamping forces holding the mold walls 74*a*–74*d* together are reduced.

Each of the mold walls 74*a*–74*d* is shifted in a direction parallel to its major faces 91,92. The distances moved by the mold walls 74*a*–74*d* are limited by the screws, such as the screw 88, of the associated clamping and pivoting mechanisms. These distances are small enough to prevent leakage of molten material from the mold cavity 82 but large enough to reduce the clamping forces on the mold walls 74*a*–74*d* to a level which allows the mold walls 74*a*–74*d* to pivot. The distances moved by the mold walls 74*a*–74*d* can be of the order of several thousandths of an inch.

When the mold walls 74*a*–74*d* have shifted, the computer 128 activates the drive assemblies 102*a*–102*d*. The drive assemblies 102*a*–102*d* pivot the mold walls 74*a*–74*d* on the pivot axes extending parallel to the major faces 91,92 of the mold walls 74*a*–74*d*. The direction of pivoting depends upon whether the taper of the mold 80 is to be increased or decreased. As the drive assemblies 102*a*–102*d* pivot the mold walls 74*a*–74*d* on the pivot axes extending parallel to the major faces 91,92, the mold walls 74*a*–74*d* simultaneously pivot on the pivot axes extending perpendicular to the major faces 91,92. Pivoting on the pivot axes extending perpendicular to the major faces 91,92 occurs in such a manner as to prevent separation of the mold walls 74*a*–74*d* from one another. For example, if the mold wall 74*a* is pivoted clockwise on the pivot axis extending parallel to its major faces 91,92, the mold wall 74*d* pivots clockwise on the pivot axis extending perpendicular to its major faces 91,92.

Once the new taper calculated by the computer 128 has been achieved, the computer 128 deactivates the drive assemblies 102*a*–102*d*. The computer 128 then causes the hydraulic pressure on the hydraulic cylinders of the clamping devices 98 and the hydraulic nuts of the clamping and pivoting mechanisms to be relieved. This allows the spring packs of the clamping devices 98 and the compression springs of the clamping and pivoting mechanisms to move the mold walls 74*a*–74*d* back into tight engagement with one another.

The above procedure is repeated whenever warranted by changes in the casting conditions.

The mold assembly 10 permits the taper of the mold 80 to be adjusted during a continuous casting operation. Moreover, the taper of the mold 80 can be changed by varying the inclination of all four mold walls 74*a*–74*d*. By providing for automatic taper adjustment while casting, the length of the mold 80 may be increased which, in turn, enables the casting speed to be increased.

The mold assembly 10 further allows the dimensions of the mold cavity 82 to be changed rapidly. This is important when the continuously cast strand formed in the mold 80 is sent to a rolling mill and the mill requests a change in the size of the strand. Changes in size can be effected by adding, removing or changing the shims 84 or by replacing the backup plates of the mold walls 74*a*–74*d* with backup plates of different thickness.

A conventional mold assembly is designed for use with copper liners which have been machined with a specific taper and, in the case of a curved mold assembly, with a specific casting radius. If the taper or radius of the copper liners is to be changed, the mold assembly must be replaced. This can take months because the tooling required for the manufacture of a mold assembly is generally not readily available. The mold assembly 10 permits this time to be greatly reduced since it can be used with copper liners having a large range of tapers and radii.

The mold assembly 10 also allows the copper liners to be removed and reinstalled easily and rapidly for remachining and replating.

The mold assembly 10 is particularly well-suited for the casting of blooms and billets. When using the mold assembly 10, blooms and billets having certain sizes need not be contained by rolls, or require only limited containment, upon exiting the mold assembly 10.

Various modifications are possible within the meaning and range of equivalence of the appended claims.

What is claimed is:

1. A continuous casting mold assembly comprising:

at least one mold wall which partly bounds a mold cavity extending in a preselected direction from a first open end thereof to a second open end thereof; and means for mounting said one mold wall for pivotal movement on a first axis and on a second axis transverse to said first axis, each of said axes extending in a direction transverse to said preselected direction.

2. The mold assembly of claim 1, wherein said axes are substantially perpendicular to one another.

3. The mold assembly of claim 1, wherein said one mold wall has a first surface facing said mold cavity and an opposite second surface facing away from said mold cavity, said mounting means including a first pivot defining said first axis and a second pivot defining said second axis, and said pivots being located on a side of said second surface remote from said mold cavity.

4. The mold assembly of claim 1, further comprising means in the region of one of said ends for clamping said one mold wall.

5. The mold assembly of claim 4, further comprising additional clamping means for said one mold wall, said additional clamping means being located closer to the other of said ends than to said one end.

6. The mold assembly of claim 5, where in said one mold wall has a major face and a minor face, one of said clamping means being arranged to act on said major face and the other of said clamping means being arranged to act on said minor face.

7. The mold assembly of claim 1, further comprising a spring for clamping said one mold wall, and means for hydraulically relieving pressure exerted by said spring.

8. The mold assembly of claim 1, further comprising means for clamping said one mold wall, means for relieving pressure exerted by said clamping means, and means for limiting movement of said one mold wall in a predetermined direction when pressure exerted by said clamping means is relieved.

9. The mold assembly of claim 8, further comprising another mold wall; and wherein said clamping means is arranged to urge said one mold wall against said other mold wall and said predetermined direction is a direction away from said other mold wall, said limiting means being designed to limit movement of said one mold wall away from said other mold wall to a distance such that said one mold wall can pivot relative to said other mold wall while leakage of molten material between said mold walls is substantially prevented.

10. The mold assembly of claim 1, further comprising means for clamping said one mold wall, said mounting means including a rotatable member which transmits force from said clamping means to and carries said one mold wall.

11. The mold assembly of claim 1, further comprising additional mold walls, each of said mold walls having a major face and a minor face, and said mold walls being arranged so that a minor face of each of said mold walls abuts a major face of another of said mold walls.

12. The mold assembly of claim 1, wherein said mounting means comprises crisscrossing shafts.

13. The mold assembly of claim 1, further comprising a temperature sensor at a predetermined location of said one mold wall to measure the temperature of said one mold wall in the region of said predetermined location.

14. The mold assembly of claim 1, wherein said one mold wall is provided with a coolant inlet and a coolant outlet; and further comprising a temperature sensor in the region of said coolant outlet to measure the temperature of coolant exiting said one mold wall.

15. The mold assembly of claim 1, further comprising means for pivoting said one mold wall, and means for connecting said pivoting means to said one mold wall, said connecting means including means for permitting relative rotation of said pivoting means and said one mold wall.

16. The mold assembly of claim 1, wherein said mounting means comprises a pivot defining said first axis, said pivot being shiftable along said first axis.

17. The mold assembly of claim 16, wherein said mounting means comprises an additional pivot defining said second axis, said additional pivot being shiftable along said second axis.

18. The mold assembly of claim 1 for use when said mold cavity is generally vertical and is designed to be filled with molten material to a predetermined level, wherein at lease one of said axes is located in the region of said predetermined level.

19. The mold assembly of claim 1, further comprising additional mold walls which cooperate with said one mold wall to define said mold cavity, and a cover for said first open end of said mold cavity, said cover being spaced from said mold walls by a gap as considered in a direction from said second open end to said first open end.

20. A method of operating a continuous casting mold having at least one mold wall which partly bounds a mold cavity extending in a preselected direction from a first open end thereof to a second open end thereof, said method comprising the steps of:

pivoting said one mold wall on a first axis; and pivoting said one mold wall on a second axis transverse to said first axis, each of said axes extending in a direction transverse to said preselected direction.

21. The method of claim 20, wherein the pivoting steps are performed on substantially perpendicular axes.

22. The method of claim 20, further comprising the step of pivoting another mold wall on a third axis in response to pivoting of said one mold wall.

23. The method of claim 20, further comprising the steps of clamping said one mold wall with a predetermined force, reducing said force, and limiting movement of said one mold wall in a predetermined direction upon reduction of said force.

24. The method of claim 23, wherein said mold has another mold wall and the clamping step comprises urging said one mold wall against said other mold wall, said predetermined direction being a direction away from said other mold wall, and the limiting step including limiting movement of said one mold wall away from said other mold wall to a distance such that said one mold wall can pivot relative to said other mold wall while leakage of molten material between said mold walls is substantially prevented.

* * * * *